United States Patent [19]

Smith

[11] 4,192,652

[45] Mar. 11, 1980

[54] PROCESS FOR PREPARING SULFUR-CONTAINING COAL OR LIGNITE FOR COMBUSTION HAVING LOW $SO_2$ EMISSIONS

[75] Inventor: Robert H. Smith, Plano, Tex.

[73] Assignee: Atlantic Richfield Company, Los Angeles, Calif.

[21] Appl. No.: 864,569

[22] Filed: Dec. 27, 1977

[51] Int. Cl.[2] ..... C10L 5/00; C10L 9/10

[52] U.S. Cl. ..... 44/10 R; 44/1 SR; 44/10 G; 44/26

[58] Field of Search ..... 44/1 R, 1 G, 10 D, 4, 44/26, 16 C, 16 E

[56] References Cited

U.S. PATENT DOCUMENTS

| | | | |
|---|---|---|---|
| 700,888 | 5/1902 | Basttistini | 44/4 |
| 709,358 | 9/1902 | Pollacsek | 44/16 E |
| 1,856,495 | 5/1932 | McGlone | 44/4 |
| 3,026,189 | 3/1962 | Hall | 44/1 G |
| 3,756,791 | 9/1973 | Mancke | 44/1 R |
| 3,948,617 | 4/1976 | Whithorn | 44/4 |

FOREIGN PATENT DOCUMENTS

| | | | |
|---|---|---|---|
| 535649 | 4/1941 | United Kingdom | 44/4 |

*Primary Examiner*—Carl F. Dees
*Attorney, Agent, or Firm*—Ronnie D. Wilson

[57] ABSTRACT

A process for preparing a coal or lignite fuel that contains sulfur for combustion wherein reduced amounts of sulfur-containing air contaminants are emitted from the combustion. In the disclosed process, the coal or lignite that contains sulfur is pulverized, deeply cleaned, mixed with a finely divided inorganic material, and then formed into briquettes or pellets.

6 Claims, No Drawings

PROCESS FOR PREPARING SULFUR-CONTAINING COAL OR LIGNITE FOR COMBUSTION HAVING LOW $SO_2$ EMISSIONS

This invention relates to a process for preparing a coal or lignite fuel, which contains sulfur, for combustion. In another aspect this invention relates to a process for preparing coal or lignite, which contains sulfur, for combustion wherein the amounts of sulfur-containing air contaminants normally emitted from such combustion are materially reduced. In another aspect, this invention relates to a method for preparing coal or lignite, which contains sulfur, for combustion with reduced emissions of contaminants whereby the prepared fuel can be shipped, stored and used in conventional equipment.

The burning of petroleum materials, such as oil and natural gas, has for years been satisfying the energy needs in this country. Recent economic and political developments have drastically increased the cost of energy sources, such as oil and natural gas. Because of the increased prices for oil and natural gas and the potential shortages of these materials, various alternative sources of energy have been investigated.

It has long been known that vast resources of coal and lignite are available as alternative sources of energy in this country. Thus, a simple solution to our increasing energy requirements would be to utilize coal and lignite as an energy source. Recently, many utility companies, industrial facilities and the like have either partially or totally changed their sources of energy to coal or lignite because of the availability and cost of such alternate energy sources.

Just as interest has shifted from oil and natural gas to alternative sources for energy, there has been an increased emphasis placed on "clean burning" fuels. The term "clean burning" is a term that broadly includes the combustion of various fuels without the production of noxious and harmful combustion products, such as sulfur oxides and the like. In fact, there has been a number of rather strict legislative and regulatory restrictions or limits placed on the amount of contaminants, such as sulfur oxides, that can be emitted into the atmosphere. It is, of course, well known in the art that energy sources, such as coal, lignite, oil and the like, that contain sulfur will produce large quantities of sulfur oxide contaminants.

Unfortunately, much of the coal and lignite found in this country in commercial quantities do contain sulfur in varying quantities. When such sulfur-containing coal and lignite materials are burned, sulfur oxides are produced and are emitted into the atmosphere, unless very costly and elaborate measures are undertaken to remove the sulfur oxides from the flue gases coming from the combustion equipment.

To satisfy the various legislative and regulatory restrictions on the amount of sulfur oxides that are emitted into the atmosphere by burning sulfur-containing coal and lignite, various types of methods and apparatus have been utilized to minimize such emissions. Such methods and apparatus have added to the cost of the conversion of the sulfur-containing coal or lignite into useful energy. In fact, in order to meet rigid requirements pertaining to emissions of sulfur oxides, the cost of various methods and apparatus for reducing sulfur oxide emissions, such as by use of complicated and costly scrubbers, precipitators and the like, have virtually made some coal and lignite supplies unattractive for the production of needed energy.

Therefore, it is desirable that inexpensive and practical methods be developed for converting sulfur-containing coal and lignite into useful energy with reduced emissions of sulfur-containing air contaminants.

Accordingly, it is an object of this invention to provide a novel integrated process for preparing a sulfur-containing coal or lignite material for combustion. It is another object of this invention to provide a novel integrated process for preparing sulfur-containing coal or lignite for combustion in conventional equipment with reduced sulfur oxide emissions. It is yet another object of this invention to prepare coal or lignite, which contains sulfur, for combustion with reduced emissions of contaminants whereby the prepared fuel can be shipped, stored and used in conventional equipment.

Other aspects, objects and advantages of this invention will be apparent to those skilled in the art from the following disclosure and appended claims.

It has been found that sulfur-containing coal or lignite can be prepared for combustion in conventional combustion equipment with reduced sulfur oxide air emissions. The present invention provides an integrated process for preparing sulfur-containing coal or lignite for combustion having low $SO_2$ emissions which comprises: reducing the particle size of the coal or lignite, deeply cleaning the coal or lignite of reduced particle size, admixing the cleaned coal or lignite with a finely divided inorganic material, and forming the resulting admixture into large particles. The resulting admixture of coal or lignite and the inorganic material can thereafter be subjected to a combustion process in conventional combustion equipment with reduced emissions of sulfur oxide combustion products. Preferably, the resulting admixture will be formed into pellets, briquettes, or other large particles for subsequent shipping, storage and/or combustion in conventional equipment. The inorganic material that is admixed with the finely divided or pulverized sulfur-containing coal or lignite can be at least one material selected from: an oxide of sodium, potassium, calcium or barium; a hydroxide of sodium, potassium, calcium or barium; a carbonate of sodium, potassium, calcium or barium; or dolomite.

In the preferred embodiments of this invention, a sulfur-containing coal or lignite material is deeply cleaned by such means as heavy media cleaning and Baum jig cleaning to remove most of the ash and pyritic sulfur. It has been found that the best results in reducing the amount of sulfur-containing air contaminants that are emitted upon burning sulfur-containing coal or lignite are obtained when the coal or lignite is finely divided and deeply cleaned and then the inorganic material is thoroughly dispersed through the finely divided coal or lignite material. Therefore, while some reduction in the amount of sulfur-containing air contaminants will be achieved by mixing the specified inorganic materials with the cleaned coal or lignite when the coal or lignite has a relatively large particle size, it is desirable, however, to reduce the particle size of the coal or lignite prior to the combustion process and to intimately admix the small particle size, cleaned coal or lignite with the inorganic material prior to such combustion. Of course, most coal or lignite is mined with mechanical equipment and often recovered from the mine site in large, irregular particle sizes. Thus, in a preferred embodiment of this invention, it is desirable to reduce the particle size of the coal or lignite to as small as is practical. As the particle size of the coal or lignite decreases, the efficiency of the instant invention in reducing the emissions of sulfur-containing air contaminants increases at a given level of the inorganic materials. Thus, there is no minimum size restriction placed on the particle size of the coal or lignite as it is admixed with the inorganic material to form the mixture for later burning. Preferably, however, the particle size of the coal or lignite will be less than about one-tenth inch in diameter in order to achieve the desired reductions in sulfur-containing emissions when the coal or lignite is burned. More preferably, the coal or lignite will have a particle size in the 48 mesh range or smaller (Tyler screen mesh sizes).

Any known method and equipment for reducing the size of the coal or lignite can be utilized, such as conventional grinding and crushing in crushers, hammer mills and the like. As used throughout this specification, the term "pulverized" coal or lignite shall mean coal or lignite that has an average particle size of less than about one-tenth inch in diameter.

Any known method and equipment for deeply cleaning the coal or lignite can be utilized, such as heavy media and Baum jig cleaning. Whichever deep cleaning method is used, it should remove all the pyritic sulfur and the majority of the ash present. The inorganic material that is used to admix with the clean, pulverized coal or lignite can be at least one material selected from the oxides of sodium, potassium, calcium or barium; the hydroxides of sodium, potassium, calcium or barium; the carbonates of sodium, potassium, calcium or barium; and dolomite. Thus, suitable examples of inorganic materials that can be utilized to admix with the clean, pulverized, sulfur-containing coal or lignite include sodium oxide, potassium oxide, calcium oxide, barium oxide, sodium hydroxide, potassium hydroxide, calcium hydroxide, barium hydroxide, sodium carbonate, potassium carbonate, sodium bicarbonate, calcium carbonate, barium carbonate and dolomite ($Ca\ Mg\ (CO_3)_2$). Mixtures of the foregoing materials can be and are often used as the inorganic material that is admixed with sulfur-containing coal or lignite. The foregoing inorganic materials can be in the form of naturally occurring minerals or in the form of relatively pure compounds. However, it will be appreciated that since large quantities of such inorganic materials will be utilized in the process of this invention, inexpensive sources of such inorganic materials will be very attractive. Therefore, the above-mentioned inorganic materials can be added to the cleaned, pulverized, sulfur-containing coal or lignite with other impurities, so long as such impurities themselves do not form noxious air contaminants when they are subjected to the combustion conditions. One particularly preferred source of the inorganic materials is naturally occurring limestone. Other preferred sources of the inorganic materials include lime and industrial waste materials that contain any of the foregoing components in appreciable quantities. Aqueous solutions or slurries of such materials, which are normally treated as waste products, are very attractive as sources of inorganic materials. When the inorganic materials are added to the coal or lignite in an aqueous or slurry form, substantially all of the solvent or liquid carrier should be evaporated or otherwise removed from the admixture to leave a substantially dry admixture for burning.

In the intimate admixing of the inorganic materials with the sulfur-containing coal or lignite, it will, of course, be appreciated that the inorganic materials be in a finely divided form. Therefore, when such inorganic materials are added to the cleaned, pulverized, sulfur-containing coal or lignite in a solid form, it will be necessary that they too be pulverized to a finely divided state. The inorganic materials should have a particle size in the general range of the particle sizes mentioned above for the sulfur-containing coal or lignite. The most efficient reductions in sulfur-containing air emissions are achieved when the inorganic materials are in a very finely divided state. Thus, it is preferred that the inorganic materials have a particle size of less than about 48 mesh (Tyler screen mesh). Particle sizes smaller than the 48 mesh size are the most preferred. In instances where the inorganic material can be dissolved in a suitable solvent, such as an aqueous solution of sodium hydroxide and the like, improved efficiencies may be obtained.

Any suitable means for reducing the particle size of the inorganic materials can be utilized, such as by grinding, crushing and the like.

The cleaned, pulverized coal or lignite and the finely divided, inorganic materials can be intimately admixed together by any suitable means. It is important, however, that an intimate admixture be formed whereby the inorganic material is completely dispersed throughout a mass of the cleaned, pulverized coal or lignite. Therefore, tumblers, ribbon mills and the like can be utilized to form the intimate admixture. As previously mentioned, a solution of the inorganic material is very beneficial for thoroughly dispersing the inorganic material throughout the mesh of the pulverized coal or lignite. In such instances the solution of the inorganic material can be conveniently sprayed on the surface of the coal or lignite and the solvent can be removed by evaporation. Another suitable method for applying the inorganic material to the coal or lignite is by forming a slurry of the finely divided, inorganic material in a suitable carrier, such as water and the like, and thereafter spraying the slurry on the surface of the coal or lignite while tumbling or shaking the coal to insure a complete dispersion of the slurry throughout the mesh of the coal or lignite.

Problems may be experienced in the handling, shipping, storage and burning of the admixture of finely divided, cleaned coal or lignite and the inorganic material. The finely divided solids are prone to blow and be dispersed in even slight air currents. There is also a danger of explosions when finely divided, cleaned coal or lignite is handled, stored or shipped. Admixtures of finely divided, cleaned coal or lignite and the inorganic materials may also tend to separate due to differing densities when they are handled, shipped or stored, especially under conditions where such admixtures are subjected to vibrations. Therefore, the admixture will be formed into pellets, briquettes or other larger particles to allow the admixture to be safely and efficiently handled, shipped, stored and used in conventional equipment. The admixture of inorganic material with the cleaned coal or lignite can be agglomerated or pelletized to produce a product which can be safely handled, shipped, or stored, without appreciable dust loss and can be supplied to conventional combustion apparatus with conventional equipment normally used for handling and stoking coal or lignite in large pieces.

Any suitable method for forming the pellets, briquettes or larger pieces of the admixture can be utilized. In forming the pellets, briquettes and other larger pieces, it is particularly desirable to utilize binders or adhesives, such as small amounts of coal tar pitch, petroleum pitch and residue materials, such as vacuum residuum, or other adhesive materials, such as lignin sulphates and the like, that are obtained as by-products in the paper industry. By mixing or coating the small, finely divided particles of coal or lignite and inorganic material with a suitable adhesive material, such as those mentioned above, and thereafter submitting the mixture to an agglomerating, prilling, or a compressing process, larger particles, prills, pellets, or briquettes can be formed. Such larger discrete particles, prills, pellets, briquettes, and the like can be shipped, handled, stored and used without the disadvantages normally associated with powdered or pulverized coal or lignite. By utilizing the technique of forming the safe and convenient pellets, briquettes or larger pieces of the admixture, the sulfur-containing coal or lignite can be burned in conventional combustion equipment, such as stoker-type furnaces, with greatly reduced emissions of sulfur contaminants.

The amount of inorganic material that will be added to and admixed with the cleaned, pulverized coal or lignite will depend on the amount of sulfur that remains in the coal or lignite after cleaning. Normally, the inorganic material will be added to the cleaned coal or lignite in an amount such that at least a stoichiometric amount of the inorganic material is present with respect to the amount of sulfur remaining in the coal or lignite. The stoichiometric amounts of the inorganic materials are calculated on the basis of two-pound atoms of the sodium or potassium compounds per one-pound atom of sulfur contained within the cleaned coal or lignite and one-pound atom of the barium or calcium compounds, including dolomite, per pound atom of the sulfur contained in the cleaned coal or lignite. Expressed in another way, the inorganic materials will be added to the clean coal or lignite in such amounts as to provide an atomic ratio of sodium or potassium to sulfur of at least 2:1 and an atomic ratio of calcium or barium to sulfur of at least 1:1. While there will be some reduction in the amount of sulfur-containing contaminants that are emitted from the combustion chamber when the inorganic materials are added in quantities less than those stated above, the optimum sulfur reduction will be obtained when the above-mentioned mol ratios are at least those as stated.

Since the inorganic materials that are added to the cleaned coal or lignite are, in fact, ash-forming materials, it will be appreciated that it is undesirable to add large excesses of the inorganic materials. From a practical standpoint, the inorganic materials will be added in amounts such that the final admixture will have an atomic ratio of calcium to sulfur or barium to sulfur of from about 1:1 to about 5:1 and an atomic ratio of potassium to sulfur or sodium to sulfur of from about 2:1 to about 10:1 to achieve significant reductions in the amount of sulfur-containing emissions upon combustion, yet, to minimize the amount of undesirable ash formed upon combustion of the coal or lignite. Since the cleaned coal and lignite will contain less than five weight percent sulfur, it will be appreciated that the final admixture of the sulfur or lignite with the inorganic material will not contain great amounts of the inorganic ash-forming material.

In accordance with the integrated process of the present invention, sulfur-containing coal or lignite is ground to a particle size of less than about one-tenth inch in diameter. The ground coal or lignite is next subject to Baum jig cleaning which removes the majority of the ash and all the pyritic sulfur contained therein. Subsequently, the clean, ground coal or lignite is intimately admixed with limestone which has been ground to less than about one-tenth inch in diameter. The admixture of clean ground coal or lignite and limestone is pelletized into one and one-fourth inch diameter by one-inch thick cylindrical pellets. The pellets are burned and emit 200% less sulfur than coal burned which has not been prepared by the novel integrated process of the present invention.

The foregoing illustrates the efficiency of the integrated process for reducing sulfur-containing emissions in the flue gas when coal is burned under self-sustained conditions.

Various changes and modifications may be made in the foregoing disclosure without departing from the spirit and scope of this invention.

I claim:

1. A process for preparing sulfur-containing coal or lignite for combustion having low $SO_2$ emissions, which comprises in combination:

(a) reducing the particle size of said coal or lignite;

(b) deeply cleaning said coal or lignite of reduced particle size;

(c) admixing said clean coal or lignite with a finely divided inorganic material selected from the group consisting of an oxide; hydroxide; or carbonate of sodium, potassium, calcium or barium; and dolomite;

(d) forming said resulting admixture into large particles.

2. The process of claim 1 wherein said coal or lignite from step (a) is cleaned by a heavy media method.

3. The process of claim 1 wherein said coal or lignite from step (a) is cleaned by a Baum jig method.

4. The process of claim 1 wherein a binder material is incorporated into said admixture from step (c) prior to step (d).

5. The process of claim 1 wherein said large particles are pellets or briquettes.

6. The process of claim 1 wherein said inorganic material is limestone.

* * * * *

Notice of Adverse Decision in Interference

In Interference No. 100,844, involving Patent No. 4,192,652, R. H. Smith, PROCESS FOR PREPARING SULFUR-CONTAINING COAL OR LIGNITE FOR COMBUSTION HAVING LOW SO2 EMISSIONS, final judgment adverse to the patentee, was rendered July 22, 1983, as to claims 1, 2 and 4–6.

[*Official Gazette November 15, 1983.*]